US009098043B2

(12) United States Patent
Ogawahara et al.

(10) Patent No.: US 9,098,043 B2
(45) Date of Patent: Aug. 4, 2015

(54) IMAGE FORMING APPARATUS HAVING A SETTING DEVICE FOR SETTING A RECORDING MEDIUM SIZE

(71) Applicant: FUJI XEROX CO., LTD., Minato-ku, Tokyo (JP)

(72) Inventors: Norio Ogawahara, Kanagawa (JP); Kenji Kanai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 168 days.

(21) Appl. No.: 13/708,176

(22) Filed: Dec. 7, 2012

(65) Prior Publication Data

US 2013/0322900 A1 Dec. 5, 2013

(30) Foreign Application Priority Data

Jun. 5, 2012 (JP) ..... 2012-128278

(51) Int. Cl.
*G03G 15/00* (2006.01)
*G03G 15/20* (2006.01)

(52) U.S. Cl.
CPC ..... *G03G 15/5095* (2013.01); *G03G 15/2042* (2013.01); *G03G 15/6594* (2013.01); *G03G 2215/00734* (2013.01)

(58) Field of Classification Search
CPC ..... G03G 15/20; G03G 15/2017; G03G 15/2021; G03G 15/2032; G03G 15/2042; G03G 15/2082; G03G 2215/00413; G03G 2215/20; G03G 2215/2006; G03G 2215/1639
See application file for complete search history.

(56) References Cited

U.S. PATENT DOCUMENTS

| | | | | |
|---|---|---|---|---|
| 5,875,033 | A * | 2/1999 | Kawata et al. | 358/296 |
| 2006/0281434 | A1* | 12/2006 | Takami et al. | 455/343.1 |
| 2008/0157714 | A1* | 7/2008 | LeMay et al. | 320/107 |
| 2011/0058201 | A1* | 3/2011 | Mueller | 358/1.13 |
| 2011/0236037 | A1* | 9/2011 | Ogawahara | 399/12 |
| 2011/0318030 | A1 | 12/2011 | Ogawahara | |

FOREIGN PATENT DOCUMENTS

| | | | |
|---|---|---|---|
| JP | 2008058365 A | * | 3/2008 |
| JP | 2012-008267 A | | 1/2012 |

* cited by examiner

*Primary Examiner* — Clayton E LaBalle
*Assistant Examiner* — Victor Verbitsky
(74) *Attorney, Agent, or Firm* — Sughrue Mion, PLLC

(57) ABSTRACT

An image forming apparatus includes a fixing device that is attachable to and detachable from an apparatus body and fixes a developer image onto a recording medium; a setting unit that is provided in the fixing device and in which a size of a recording medium to be used in the fixing device is set; an acquiring unit that is provided in the apparatus body and acquires size information of a recording medium onto which the developer image is to be fixed; a determining unit that compares the size of the recording medium set in the setting unit with the size of the recording medium acquired by the acquiring unit so as to determine whether or not a fixing process is performable by the fixing device; and a notifying unit that at least provides notification of a negative determination result obtained by the determining unit.

6 Claims, 13 Drawing Sheets

FIG. 11

| PAPER-WIDTH SETTING | 0 | 1 | 2 | 3 | 4 | 5 | 6 | 7 |
|---|---|---|---|---|---|---|---|---|
| PAPER WIDTH | FREE | SA3 | A3 | A4 | A5 | AUXILIARY | AUXILIARY | AUXILIARY |
| RESISTANCE VALUE [kΩ] | 4.4 | 9.6 | 6.3 | 27 | 5.3 | 15 | 8.2 | OPEN |

IMAGE FORMING APPARATUS HAVING A SETTING DEVICE FOR SETTING A RECORDING MEDIUM SIZE

CROSS-REFERENCE TO RELATED APPLICATIONS

This application is based on and claims priority under 35 USC 119 from Japanese Patent Application No. 2012-128278 filed Jun. 5, 2012.

BACKGROUND

1. Technical Field

The present invention relates to image forming apparatuses and image forming methods.

2. Summary

According to an aspect of the invention, there is provided an image forming apparatus including a fixing device that is attachable to and detachable from an apparatus body and fixes a developer image onto a recording medium; a setting unit that is provided in the fixing device and in which a size of a recording medium to be used in the fixing device is set; an acquiring unit that is provided in the apparatus body and acquires size information of a recording medium onto which the developer image is to be fixed; a determining unit that compares the size of the recording medium set in the setting unit with the size of the recording medium acquired by the acquiring unit so as to determine whether or not a fixing process is performable by the fixing device; and a notifying unit that at least provides notification of a negative determination result obtained by the determining unit.

BRIEF DESCRIPTION OF THE DRAWINGS

An exemplary embodiment of the present invention will be described in detail based on the following figures, wherein:

FIG. 11 illustrates a setting table showing an example of combinations of paper-width settings, usable paper widths, and resistance values in the fixing device according to the exemplary embodiment of the present invention;

DETAILED DESCRIPTION

An example of an image forming apparatus according to an exemplary embodiment of the present invention will now be described.

Overall Configuration

Figure 1:
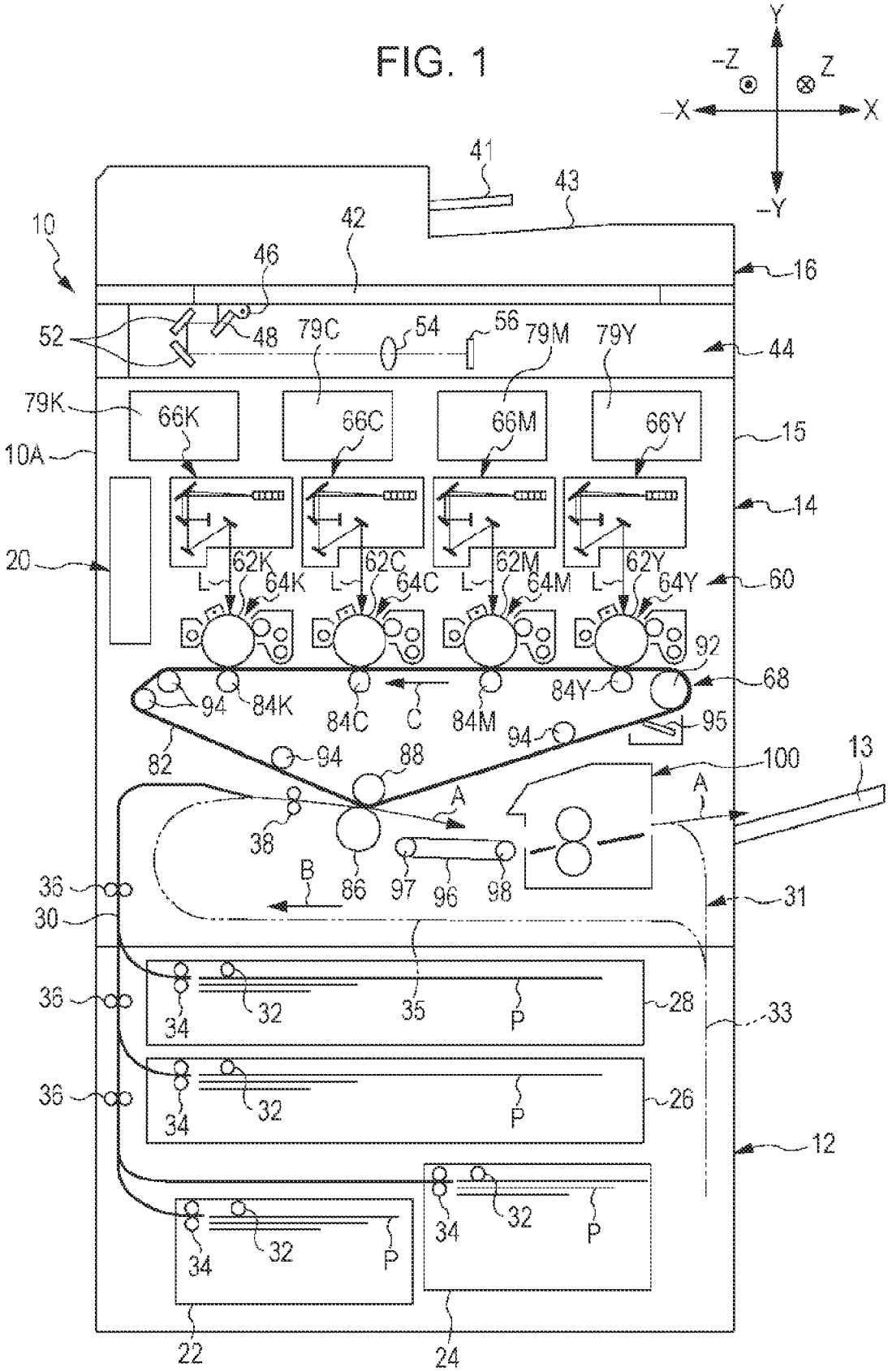
FIG. 1 illustrates the overall configuration of an image forming apparatus according to an exemplary embodiment of the present invention.

FIG. 1 illustrates an image forming apparatus 10 according to an exemplary embodiment. From bottom to top in the vertical direction (i.e., Y direction), the image forming apparatus 10 includes a paper accommodation section 12 that accommodates recording paper P as an example of a recording medium, an operating section 14 that is provided above the paper accommodation section 12 and performs image formation on the recording paper P fed from the paper accommodation section 12, a document reading section 16 that is provided above the operating section 14 and reads a document (not shown), and a controller 20 as a determining unit that is provided within the operating section 14 and controls the operation of each section in the image forming apparatus 10. The image forming apparatus 10 has an apparatus body 15 formed of components including multiple frames and plates.

In each of the drawings, a circle with an "x" therein indicates an arrow extending from the front side toward the rear side of the drawing, and a circle with a dot in the center indicates an arrow extending from the rear side toward the front side of the drawing. Furthermore, assuming that the image forming apparatus 10 is viewed from the front where a user (not shown) stands, the directions indicated by arrows X, −X, Y, −Y, Z, and −Z respectively correspond to rightward, leftward, upward, downward, rearward, and forward directions.

The paper accommodation section 12 has a first accommodation portion 22, a second accommodation portion 24, a third accommodation portion 26, and a fourth accommodation portion 28 that are capable of accommodating recording paper P of different sizes. The first accommodation portion 22, the second accommodation portion 24, the third accommodation portion 26, and the fourth accommodation portion 28 are each provided with a feed roller 32 that feeds the accommodated recording paper P in a one-by-one fashion, a transport roller 34 that transports each fed sheet of recording paper P to a transport path 30 provided within the image forming apparatus 10, and an acquiring section 140 (see FIG.

10) as an example of an acquiring unit that acquires size information of the recording paper P onto which a developer image is to be fixed.

Furthermore, multiple transport rollers 36 that transport the recording paper P one-by-one are provided along the transport path 30 at positions downstream of the transport rollers 34. Moreover, a positioning roller 38 that temporarily stops the recording paper P and feeds the recording paper P to a second-transfer device, to be described later, at a predetermined timing so as to perform an image-transfer positioning process is provided on the transport path 30 at a position downstream of the transport rollers 36 in the transport direction of the recording paper P.

In the front view of the image forming apparatus 10, an upstream segment of the transport path 30 extends linearly in the Y direction from the −X side of the paper accommodation section 12 to a lower area at the −X side of the operating section 14. A downstream segment of the transport path 30 extends from the lower area at the −X side of the operating section 14 to a paper output section 13 provided at an X-side surface of the operating section 14. Furthermore, the transport path 30 is connected to a duplex transport path 31 along which the recording paper P is transported and inverted for forming images on both faces of the recording paper P. The transport direction of the recording paper P when duplex printing is not to be performed thereon is indicated by an arrow A.

In the front view of the image forming apparatus 10, the duplex transport path 31 has an inverting segment 33 extending linearly in the −Y direction from a lower area at the X side of the operating section 14 toward the X side of the paper accommodation section 12, and a transport segment 35 that receives the trailing edge of the recording paper P from the inverting segment 33 and transports the recording paper P in the −X direction (indicated by an arrow B). A downstream end of the transport segment 35 is connected to a position upstream of the positioning roller 38 in the transport path 30 via a guide member (not shown). In FIG. 1, the inverting segment 33 and the transport segment 35 are provided with multiple transport rollers (not shown) that are spaced apart from each other. A switch member for switching between the transport path 30 and the duplex transport path 31 and a switch member for switching between the inverting segment 33 and the transport segment 35 are also not shown.

The document reading section 16 is provided with a document tray 41 on which multiple documents (not shown) may be placed, a platen glass 42 on which a single document may be placed, a document reader 44 that reads the document placed on the platen glass 42, and a document output portion 43 onto which the read document is output.

The document reader 44 has a light radiating unit 46 that radiates light onto the document placed on the platen glass 42, a single full-rate mirror 48 and two half-rate mirrors 52 at which reflected light from the document irradiated with the light from the light radiating unit 46 is switched back by being reflected in a direction parallel to the platen glass 42, an imaging lens 54 that receives the reflected light switched back by the full-rate mirror 48 and the half-rate mirrors 52, and a photoelectric converter 56 that converts the reflected light focused by the imaging lens 54 into an electrical signal.

The electrical signal converted by the photoelectric converter 56 is image-processed by an image processor (not shown) so as to be used for image formation. The full-rate mirror 48 moves at a full rate along the platen glass 42, whereas the half-rate mirrors 52 move at a half rate along the platen glass 42.

In the apparatus body 15, the operating section 14 is provided with an image forming section 60 as an example of a developer-image forming unit that forms toner images (developer images) on the recording paper P, and a fixing device 100 that is attachable to and detachable from the apparatus body 15 and fixes the developer images formed on the recording paper P by the image forming section 60 onto the recording paper P.

The image forming section 60 includes image forming units 64K, 64C, 64M, and 64Y having photoconductors 62K, 62C, 62M, and 62Y provided in correspondence with black (K), cyan (C), magenta (M), and yellow (Y) toners as examples of developers, exposure units 66K, 66C, 66M, and 66Y that perform an exposure process by emitting light beams L toward the outer peripheral surfaces of the photoconductors 62K, 62C, 62M, and 62Y, and a transfer unit 68 that transfers images formed in the image forming units 64K, 64C, 64M, and 64Y onto the recording paper P. In the description hereinafter, if Y, M, C, and K are to be distinguished from one another, reference characters Y, M, C, and K will be added as suffixes to the corresponding reference numerals, whereas if Y, M, C, and K are not to be distinguished from one another due to having the same configuration, the suffixes Y, M, C, and K will be omitted.

Each exposure unit 66 scans a light beam emitted from a light source (not shown) by using a rotating polygon mirror (not provided with a reference numeral or character) and reflects the light beam by using multiple optical components including a reflecting mirror so as to emit the light beam L corresponding to the toner toward the corresponding photoconductor 62. The photoconductor 62 is provided below (i.e., at the −Y side of) the exposure unit 66.

Figure 2:
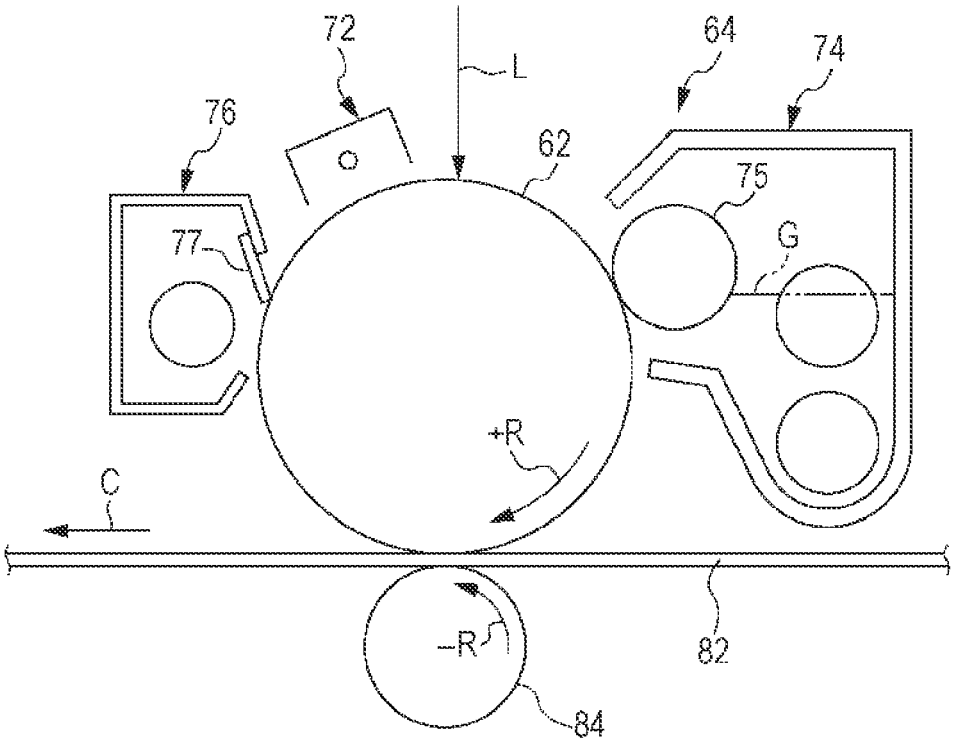
FIG. 2 illustrates one of image forming units according to the exemplary embodiment of the present invention.

Referring to FIG. 2, each image forming unit 64 includes the photoconductor 62 provided in a rotatable manner in a direction indicated by an arrow +R (i.e., clockwise direction in the drawing), and also includes a charging unit 72, a developing unit 74, and a cleaning unit 76 that are disposed facing the outer peripheral surface of the photoconductor 62 and are arranged in that order from the upstream side toward the downstream side in the rotational direction. The charging unit 72 and the developing unit 74 are disposed such that the outer peripheral surface of the photoconductor 62 is irradiated with the light beam L at a position between the charging unit 72 and the developing unit 74. An intermediate transfer belt 82, to be described later, is in contact with the outer peripheral surface of the photoconductor 62 at a position between the developing unit 74 and the cleaning unit 76.

The photoconductor 62 is constituted of an aluminum cylindrical base material (not shown) having electrical conductivity and connected to ground, and a surface layer (not shown) including a charge generating layer, a charge transport layer, and a protection layer stacked over the outer peripheral surface of the base material in that order in the radial direction thereof. The photoconductor 62 is rotatable in the direction of the arrow +R by driving a motor (not shown). The charging unit 72 is, for example, of a corotron type that electrostatically charges the outer peripheral surface of the photoconductor 62 to the same polarity as the toner by corona discharge generated by applying voltage to a wire. By radiating the light beam L based on image data onto the outer peripheral surface of the electrostatically-charged photoconductor 62, a latent image (i.e., electrostatic latent image) is formed thereon.

The developing unit 74 accommodates, for example, a developer G having a mixture of magnetic carrier particles and a toner and is provided with a cylindrical developing sleeve 75 that embraces therein a magnet roller (not shown)

having multiple magnetic poles in the circumferential direction thereof. In the developing unit 74, when the developing sleeve 75 rotates, a magnetic brush is formed in an area thereof that faces the photoconductor 62, and at the same time, a voltage applying unit (not shown) applies development bias to the developing sleeve 75 so that the latent image on the outer peripheral surface of the photoconductor 62 is made into a visible image by using the toner, thereby forming a toner image (developer image). Each developing unit 74 is supplied with a toner from a corresponding toner cartridge 79 (see FIG. 1) provided above the image forming section 60.

The cleaning unit 76 has a cleaning blade 77 that is disposed such that an edge thereof is oriented in the rotational direction of the photoconductor 62 and is in contact with the outer peripheral surface of the photoconductor 62. By using the cleaning blade 77, the cleaning unit 76 removes and collects residual toner from the outer peripheral surface of the photoconductor 62 after a transfer process. The aforementioned intermediate transfer belt 82 onto which the toner image developed by the developing unit 74 is first-transferred is provided downstream of the developing unit 74 in the rotational direction of the photoconductor 62.

As shown in FIG. 1, the transfer unit 68 includes the intermediate transfer belt 82, first-transfer rollers 84 that first-transfer the toner images from the photoconductors 62 onto the intermediate transfer belt 82, and a second-transfer roller 86 and an auxiliary roller 88 that second-transfer the toner images superposed on the intermediate transfer belt 82 onto the recording paper P.

The intermediate transfer belt 82 is, for example, an endless belt in the form of a film composed of plastic, such as polyimide or polyamide, containing carbon black (antistatic agent). Multiple rotatable transport rollers 94 and a drive roller 92 rotationally driven by a motor (not shown) and disposed near the image forming unit 64Y and the first-transfer roller 84Y are disposed within the intermediate transfer belt 82. The intermediate transfer belt 82 is wrapped around the first-transfer rollers 84K, 84C, 84M, and 84Y, the drive roller 92, the transport rollers 94, and the auxiliary roller 88. Thus, when the drive roller 92 rotates counterclockwise in the drawing, the intermediate transfer belt 82 rotates in a direction indicated by an arrow C (i.e., in the counterclockwise direction in the drawing).

Each first-transfer roller 84 is formed by, for example, forming a sponge layer (not shown) around a columnar shaft composed of metal, such as stainless steel, and the opposite ends of the shaft are supported by bearings so that the first-transfer roller 84 is rotatable. Moreover, a voltage with reversed polarity relative to the polarity of the toner is applied to the first-transfer roller 84 from a power source (not shown).

The second-transfer roller 86 has, for example, the same configuration as the first-transfer rollers 84 and is rotatably provided downstream of the positioning roller 38 in the transport path 30. The second-transfer roller 86 is in contact with the outer peripheral surface of the intermediate transfer belt 82 so as to nip the intermediate transfer belt 82 together with the auxiliary roller 88. The second-transfer roller 86 is connected to ground.

The auxiliary roller 88 serves as a counter-electrode for the second-transfer roller 86 and receives a second-transfer voltage via a metallic electric-feed roller (not shown) disposed in contact with the outer peripheral surface of the auxiliary roller 88. When the second-transfer voltage is applied to the auxiliary roller 88, a potential difference is generated between the auxiliary roller 88 and the second-transfer roller 86, so that the toner images on the intermediate transfer belt 82 are second-transferred onto the recording paper P transported to the contact area between the second-transfer roller 86 and the intermediate transfer belt 82.

A cleaning blade 95 that removes residual toner and paper particles from the intermediate transfer belt 82 after the second-transfer process is disposed facing the outer peripheral surface of the intermediate transfer belt 82 at a position near the drive roller 92. For example, a light-reflecting seal member (not shown) is fixed to the outer peripheral surface of the intermediate transfer belt 82 at a reference position of a non-transfer region to which the toner images are not transferred. A position sensor (not shown) that detects the reference position of the intermediate transfer belt 82 by radiating light to the non-transfer region of the intermediate transfer belt 82 and receiving the light reflected from the seal member is provided at a position that may face the seal member. Consequently, in the image forming section 60, an image forming process in each section is performed on the basis of a reference-position signal obtained by the position sensor.

A transport belt 96 that transports the recording paper P having the toner images second-transferred thereon toward the fixing device 100, to be described later, is provided downstream of the second-transfer roller 86 in the transport direction of the recording paper P. The transport belt 96 is rotatable by a support roller 97, a drive roller 98, and a driving unit having a motor and a gear (not shown) so as to be capable of transporting the recording paper P toward the fixing device 100.

In the image forming apparatus 10, a rail-shaped guide member (not shown) is provided below and at the X side of the transport belt 96. This guide member is ejectable in the –Z direction (i.e., toward the front side). The fixing device 100 is placed on the ejected guide member and is pushed in the Z direction (i.e., toward the rear side) so as to become attached to the apparatus body 15. The fixing device 100 may be detached from the apparatus body 15 by ejecting the guide member and the fixing device 100 toward the front side of the drawing and then moving the fixing device 100 in the Y direction.

Figure 3:
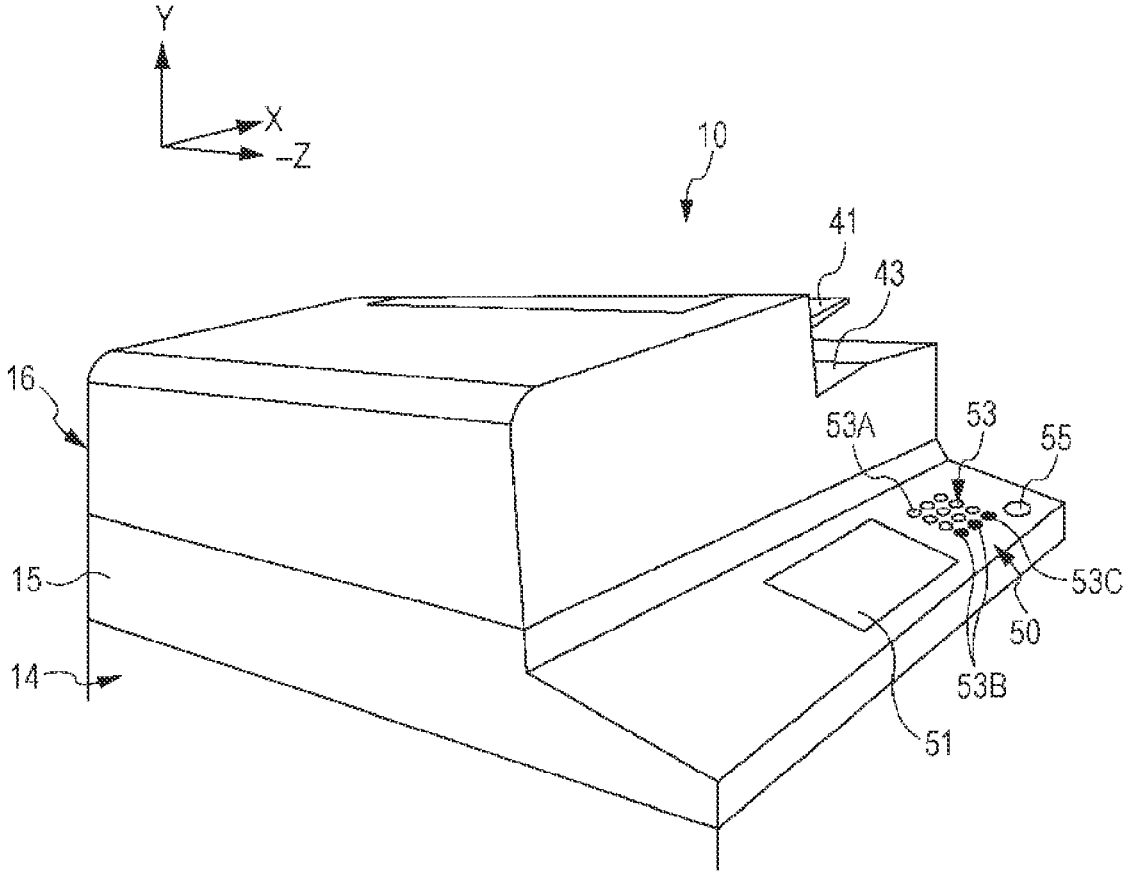
FIG. 3 is a perspective view showing an upper section of the image forming apparatus according to the exemplary embodiment of the present invention.

Referring to FIG. 3, an operation panel 50 operable by an operator (not shown) is provided in the apparatus body 15 at the –Z side of the document reading section 16. The operation panel 50 is provided with, for example, a display panel 51 as an example of a display and a notifying unit that display a determination result, which will be described later, multiple input buttons 53 disposed adjacent to the display panel 51, and a start button 55 to be used when starting (executing) a document reading process or an image forming process.

The display panel 51 is a touch-screen that displays notification information to the operator and that can recognize items according to pressed positions in a display region displaying various kinds of information. When the controller 20 (see FIG. 1) determines the size of recording paper P, to be described later, the display panel 51 at least notifies the operator of a negative determination result.

The input buttons 53 include a numerical keypad 53A for inputting numerical values, cursor buttons 53B for moving a cursor (not shown) displayed in the display panel 51, and a selection button 53C for selecting (executing) an item indicated by the cursor. The cursor buttons 53B and the selection button 53C are an example of a selecting unit that can be used by the user to select whether or not to forcedly use the attached fixing device 100 (see FIG. 1) when the determination result related to the size of the recording paper P obtained by the controller 20 (see FIG. 1) is negative. As mentioned above, displayed sections in the display panel 51 that can be selected by the user touching these displayed sections are also an example of the selecting unit.

Configuration of Relevant Sections

Next, an example of the fixing device 100 will be described below.

Figure 4:
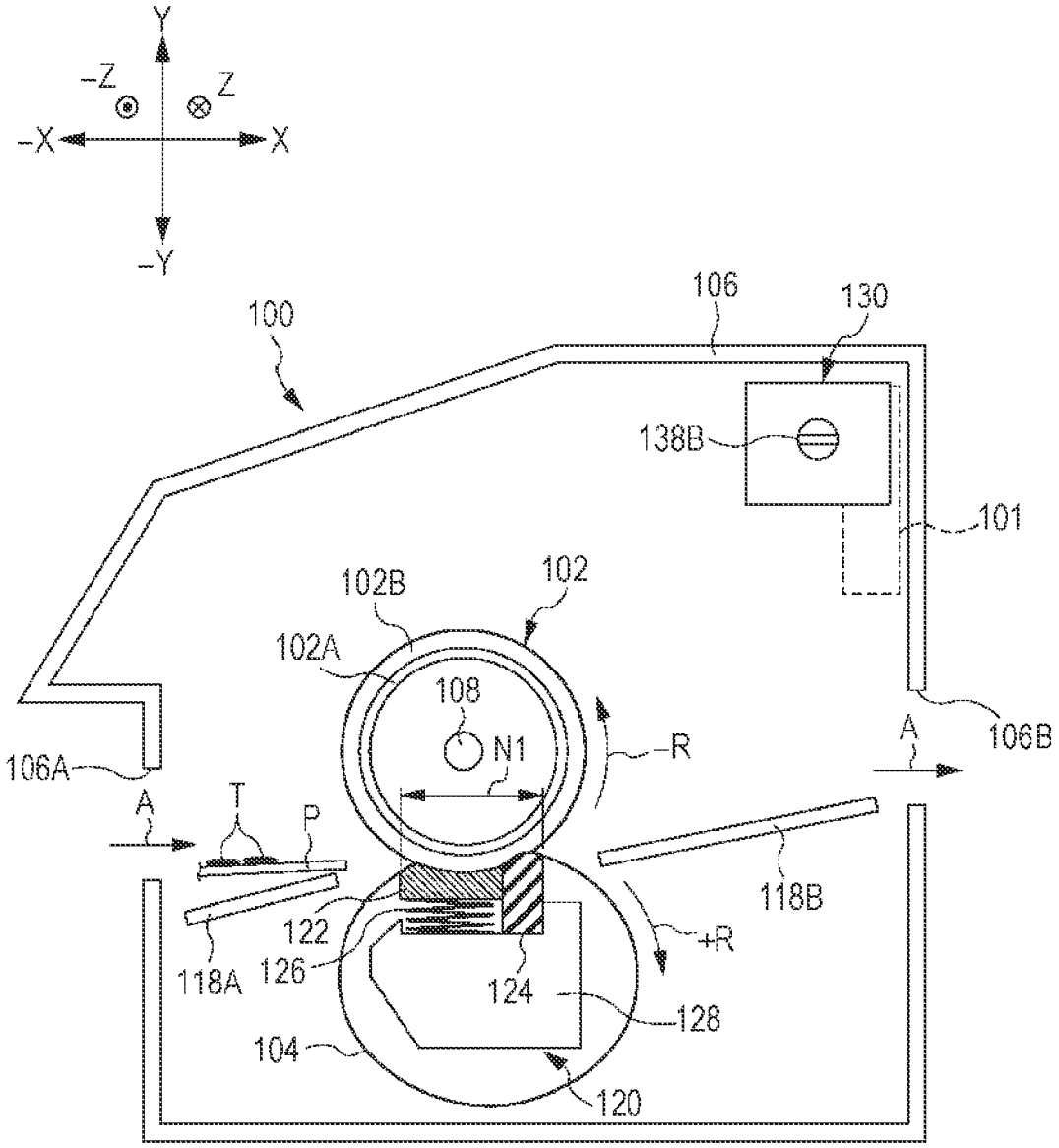
FIG. 4 illustrates the configuration of a fixing device according to the exemplary embodiment of the present invention.

Referring to FIG. 4, the fixing device 100 includes a housing 106 serving as a fixing-device body, a fixing roller 102 that is provided within the housing 106 and fixes a toner image T onto the recording paper P, an endless belt member 104 that is in contact with the outer peripheral surface of the fixing roller 102, and a pressing section 120 that is provided within the belt member 104 and presses the belt member 104 toward the outer peripheral surface of the fixing roller 102. In FIG. 4, a temperature sensor that detects the temperature of the fixing roller 102 is not shown.

The housing 106 has an opening 106A in a sidewall thereof at the −X side and an opening 106B in a sidewall thereof at the X side. The openings 106A and 106B have sizes sufficient for the recording paper P to pass therethrough. Guide members 118A and 118B that guide the recording paper P are respectively provided in front of and behind the fixing roller 102 (i.e., at the left and right sides thereof in the drawing) in the transport direction (indicated by an arrow A) of the recording paper P. Thus, the recording paper P with the unfixed toner image T enters through the opening 106A and is guided by the guide member 118A to the fixing roller 102 where the toner image T is fixed onto the recording paper P. Then, the recording paper P with the fixed toner image T is guided by the guide member 118B so as to be output from the opening 106B.

Figure 6:
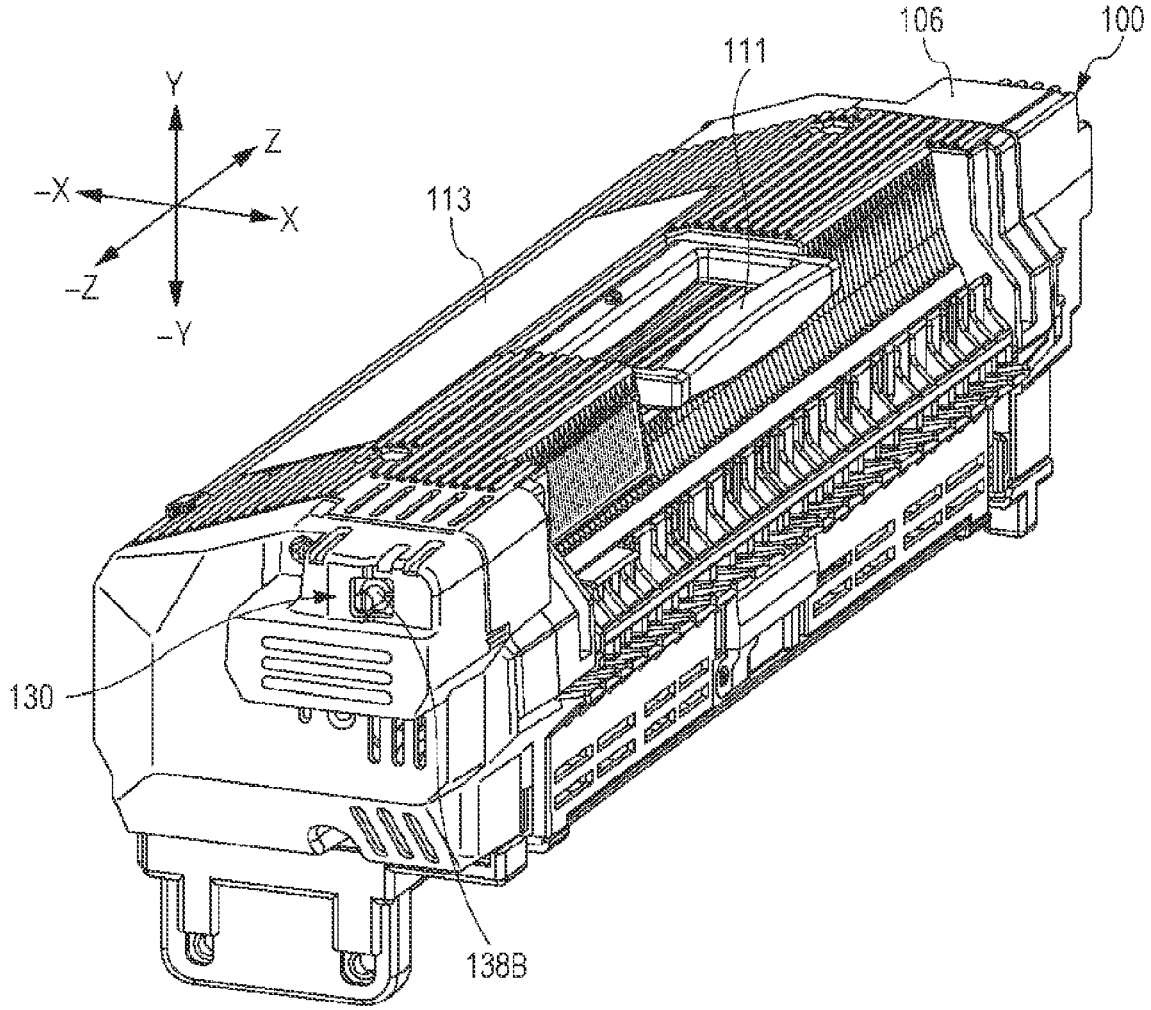
FIG. 6 is a perspective view of the fixing device according to the exemplary embodiment of the present invention, as viewed from the front side.
Figure 7:
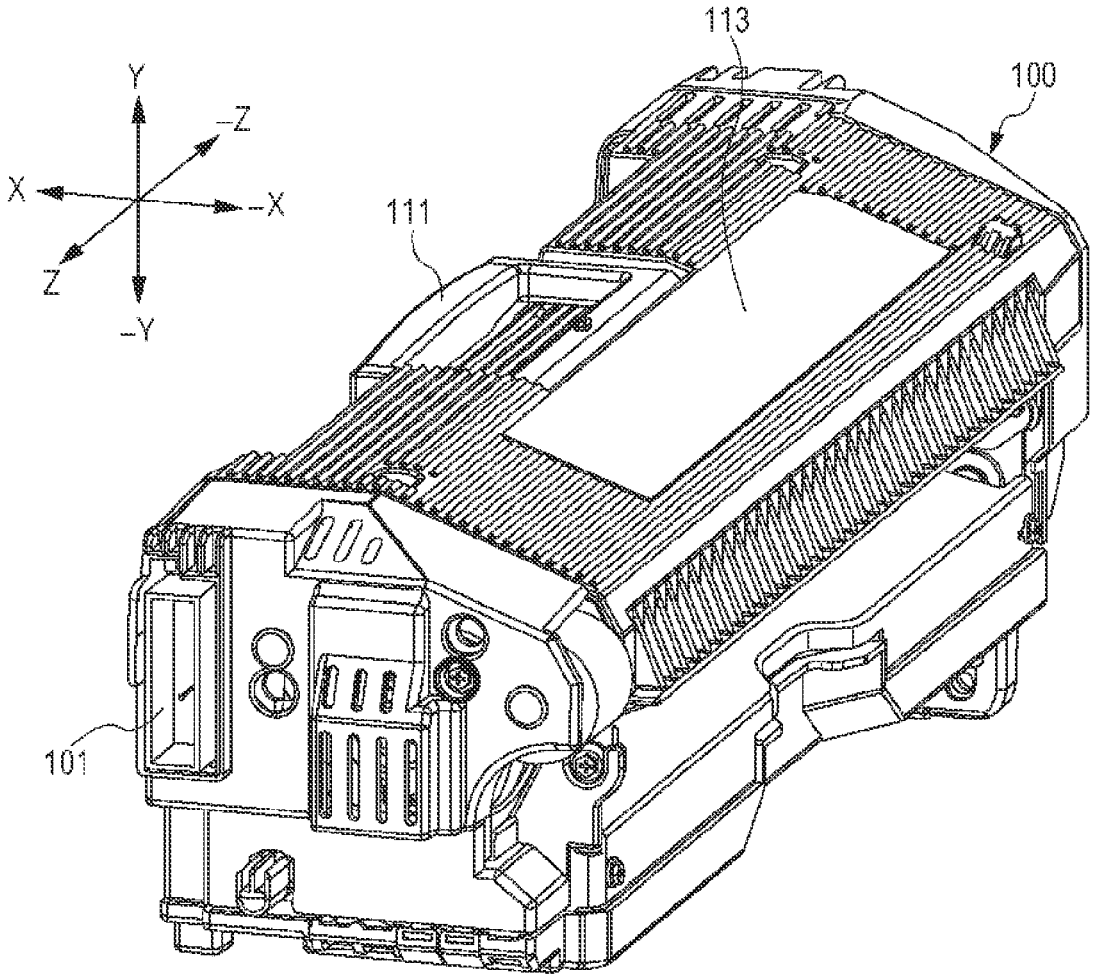
FIG. 7 is a perspective view of the fixing device according to the exemplary embodiment of the present invention, as viewed from the rear side.

Referring to FIG. 6, a setting section 130 as an example of a setting unit in which the size of recording paper P to be used in the fixing device 100 is set is provided at an end of the fixing device 100 at the −Z side. A detailed description of the setting section 130 will be provided later. Furthermore, referring to FIG. 7, a connector 101 protrudes in the Z direction from a side surface of the fixing device 100 at the Z side. The connector 101 is engaged with a connector (not shown) in the apparatus body 15 when the fixing device 100 is attached to the apparatus body 15 (see FIG. 1) so that electricity can be applied to the fixing device 100.

In addition, an upper portion of the housing 106 of the fixing device 100 in the Y direction is provided with a handle 111 that may be held by the operator (user) when attaching or detaching the fixing device 100, and a label 113 having a printed message, such as "CAUTION HOT", for cautioning the operator when handling the fixing device 100.

Referring to FIG. 4, the fixing roller 102 includes, for example, a cylindrical cored bar 102A and an elastic layer 102B covering the outer peripheral surface of the cored bar 102A. The outer peripheral surface of the elastic layer 102B is coated with a fluoroplastic release layer (not shown). For example, a halogen lamp 108 serving as a heating source is provided within the cored bar 102A. The cored bar 102A may be composed of, for example, metal, such as aluminum, SUS, iron, copper, or brass, or an alloy. The elastic layer 102B may be composed of, for example, silicone rubber.

The belt member 104 is formed by, for example, coating a surface of an endless polyamide base material with fluoroplastic. The outer peripheral surface of the belt member 104 is disposed in contact with the outer peripheral surface of the fixing roller 102 along the rotation axis of the fixing roller 102 such that the axial direction of the fixing roller 102 and the axial direction of the belt member 104 are parallel to each other.

The fixing roller 102 and the belt member 104 are rotationally driven so as to rotate in opposite directions from each other. Therefore, the fixing roller 102 and the belt member 104 move in the same direction in a region (which will be referred to as "pressing region" hereinafter) where they are in contact with each other. For example, because the fixing roller 102 is rotated in a direction indicated by an arrow −R (i.e., in the counterclockwise direction in the drawing) and the belt member 104 is rotated in a direction indicated by an arrow +R (i.e., in the clockwise direction in the drawing), the recording paper P transported to the pressing region is nipped by the fixing roller 102 and the belt member 104 and is transported in the direction of the arrow A by the rotation of the fixing roller 102 and the belt member 104. The width of the pressing region in a direction orthogonal to the rotation axis of the fixing roller 102 is defined as N1.

The pressing section 120 includes a first pressing member 122 that is disposed at the upstream side in the pressing region in the transport direction (i.e., the direction of the arrow A) of the recording paper P and that presses the belt member 104 toward the fixing roller 102, a second pressing member 124 that is disposed at the downstream side in the pressing region in the direction of the arrow A and that presses the belt member 104 toward the fixing roller 102, and a holder 128. For example, in the pressing region, the pressing width of the first pressing member 122 is larger than the pressing width of the second pressing member 124, and the total width of the pressing width of the first pressing member 122 and the pressing width of the second pressing member 124 is equal to N1.

The first pressing member 122 is composed of, for example, silicone rubber and has a long shape extending longitudinally in the axial direction of the belt member 104. The first pressing member 122 is disposed beside and upstream of the second pressing member 124 in the direction of the arrow A and is biased toward the inner peripheral surface of the belt member 104 by a spring 126 provided at an upper portion of the holder 128 so as to press the belt member 104 toward the outer peripheral surface of the fixing roller 102.

The second pressing member 124 is composed of liquid crystal polymer and has a rectangular parallelepiped shape. The second pressing member 124 has a long shape extending longitudinally in the axial direction of the belt member 104 and is fixed to the upper surface of the holder 128. The second pressing member 124 is in contact with the inner peripheral surface of the belt member 104 and presses the belt member 104 toward the outer peripheral surface of the fixing roller 102. In the pressing region, a protrusion partially formed on the second pressing member 124 distorts the outer peripheral surface of the fixing roller 102 so that the distortion in the fixing roller 102 is locally increased in size. By locally increasing the size of the distortion in the fixing roller 102 in this manner, the releasing capability of the recording paper P may be achieved with a small amount of distortion, as compared with a configuration in which the distortion is generated with the entire pressing region as in a fixation method using a pair of rollers.

Figure 5:
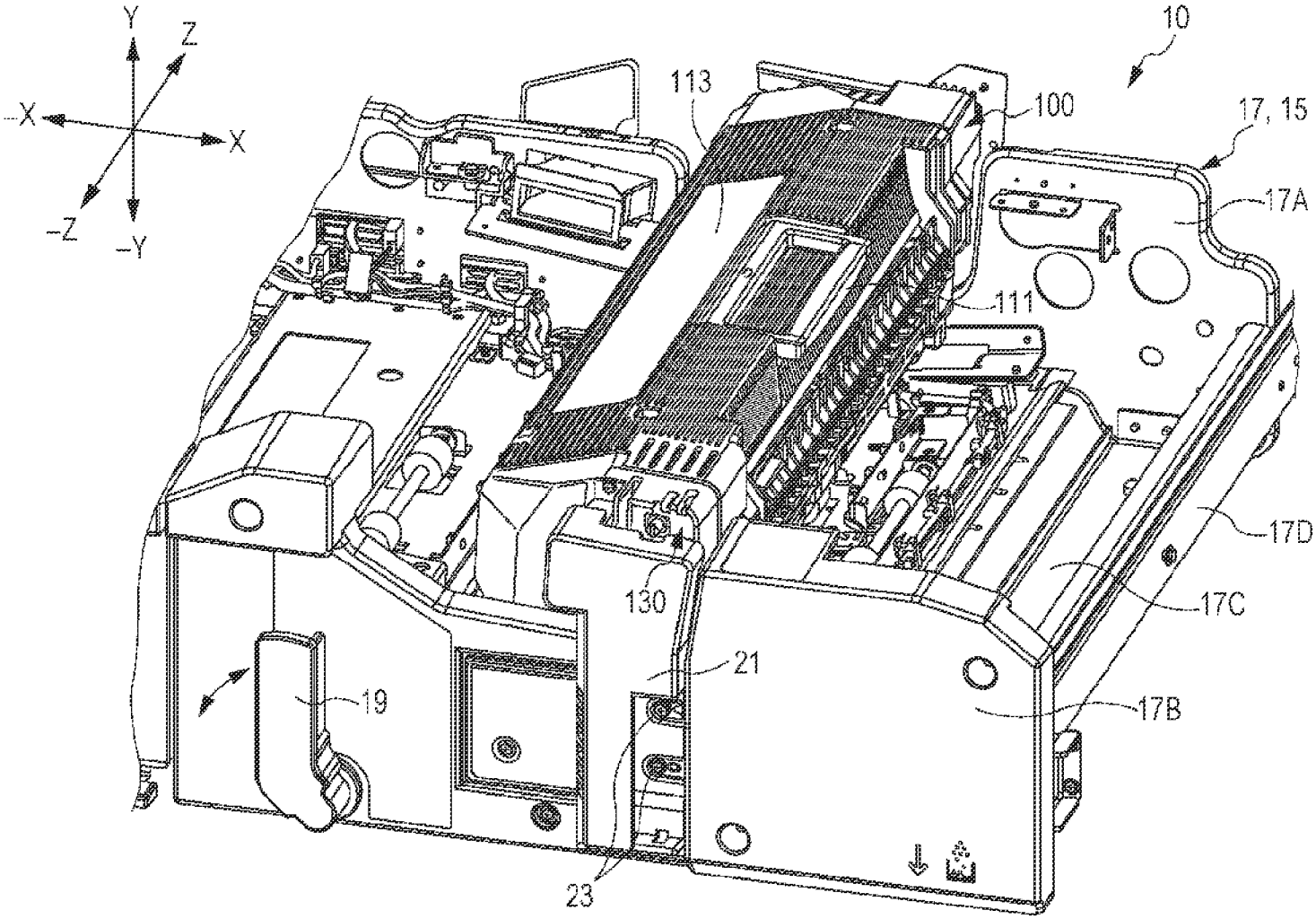
FIG. 5 is a perspective view showing a state where the fixing device according to the exemplary embodiment of the present invention is attached to an apparatus body.

Referring to FIG. 5, the apparatus body 15 is provided with an ejection unit 17 that is ejectable from the apparatus body 15 in the −Z direction along a rail member (not shown). The ejection unit 17 includes a sidewall 17A standing upright in the Y direction at the Z side, a sidewall 17B standing upright in the Y direction at the −Z side and facing the sidewall 17A, a bottom wall 17C fixed to the −Y side of the sidewall 17A and the sidewall 17B and extending across an X-Z plane, and a connection member 17D extending longitudinally in the Z direction and connecting the sidewall 17A and the sidewall 17B.

The sidewall 17A is provided with a connector (not shown) that is connected to the connector 101 (see FIG. 7) of the fixing device 100 and that is exposed toward the –Z side. The sidewall 17B is provided with an operation lever 19 that is rotated in the normal or reverse direction by the operator so as to eject the ejection unit 17 from the apparatus body 15 or set the fixing device 100 in an attached state, and a bracket 21 covering the –Z side of the fixing device 100. The bracket 21 is fixed to the sidewall 17B with screws 23.

In a state where the ejection unit 17 is ejected, the fixing device 100 is lowered from the Y side toward the –Y side and is moved in the Z direction so as to connect (engage) the connector 101 (see FIG. 7) to the connector (not shown) in the sidewall 17A. In this state, the bracket 21 is fixed at the –Z side so that the fixing device 100 becomes attached to the ejection unit 17. The fixing device 100 may be detached from the ejection unit 17 by reversing the above procedure (that is, by performing the above operation in the reverse direction).

Configuration of Setting Section

Next, the setting section 130 will be described below.

Figure 8:
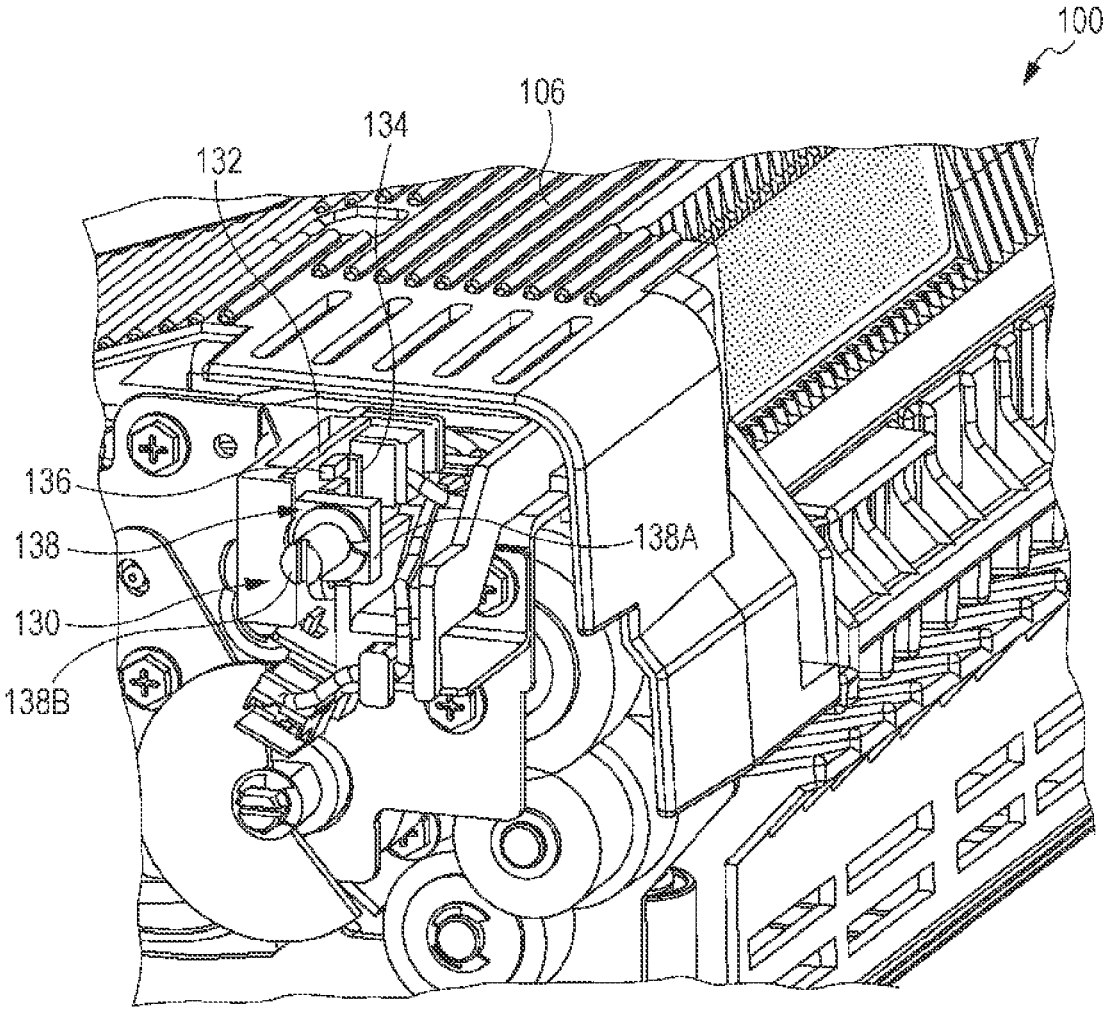
FIG. 8 is a partially enlarged view showing a setting section and a surrounding area thereof in the fixing device according to the exemplary embodiment of the present invention.
Figure 9A:
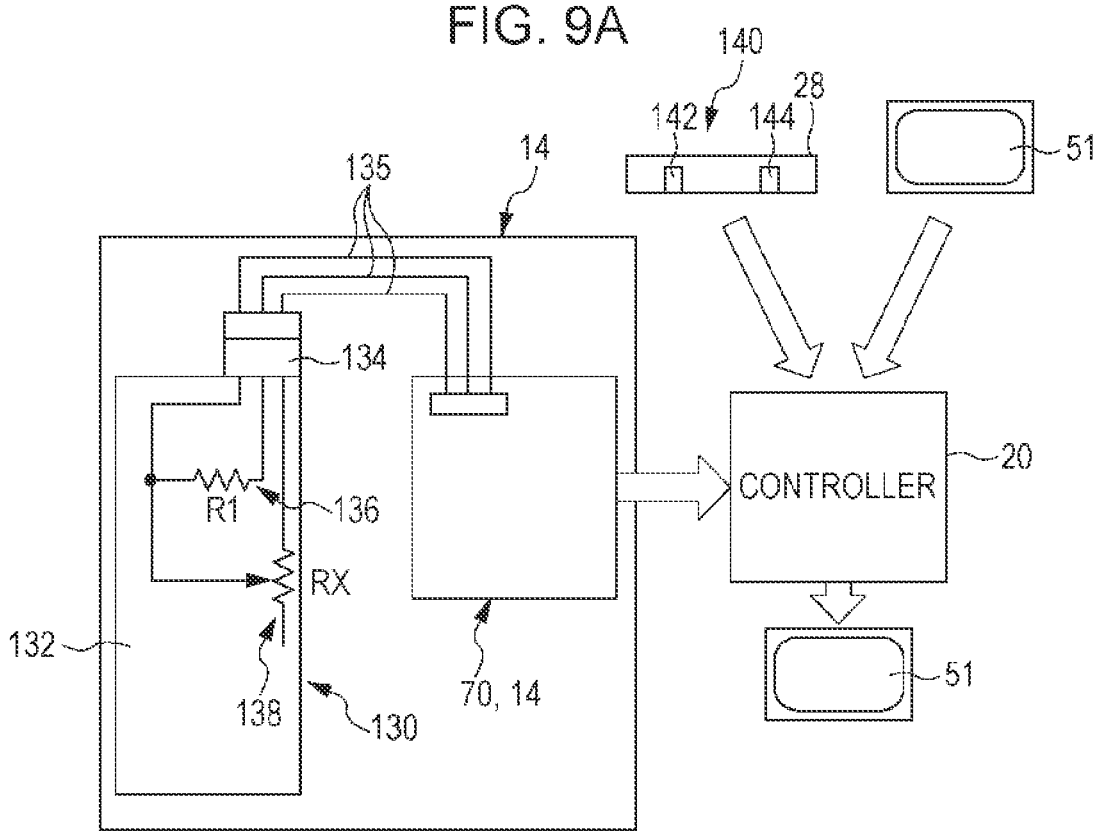
FIG. 9A illustrates a configuration that determines whether or not the fixing device according to the exemplary embodiment of the present invention is usable and provides notification of the determination result.
Figure 9B:
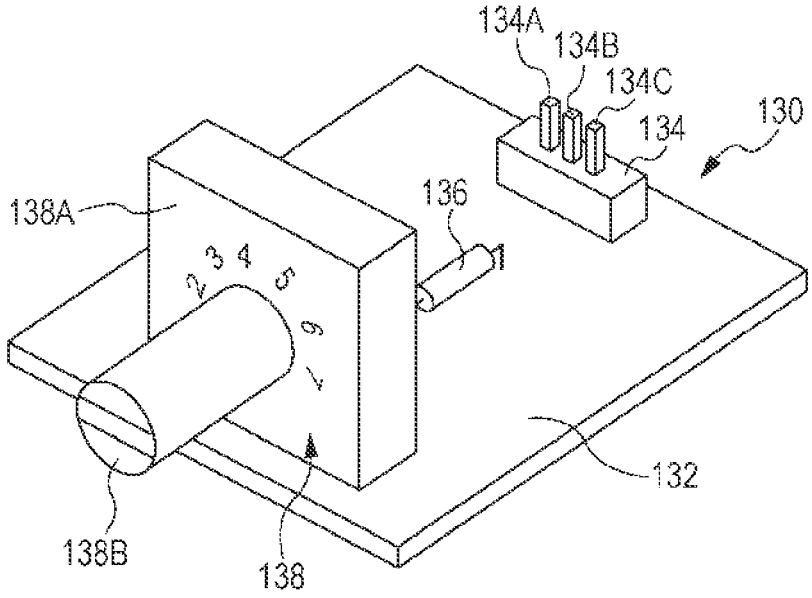
FIG. 9B illustrates the setting section according to the exemplary embodiment of the present invention.

Referring to FIGS. 8 and 9B, the setting section 130 includes a circuit board 132, a connector 134 mounted on the circuit board 132, a fixed resistor 136, and a variable resistor 138. The variable resistor 138 has a variable resistor body 138A standing upright on the circuit board 132 and an operation knob 138B protruding outward from a side surface of the variable resistor body 138A, and is capable of switching resistance values.

Referring to FIG. 9A, a resistance value of the fixed resistor 136 is defined as R1, and a resistance value of the variable resistor 138 is defined as RX (variable). The resistance value R1 corresponds to the resistance between a pin 134A and a pin 134B (see FIG. 9B) of the connector 134, and the resistance value RX corresponds to the resistance between the pin 134A and a pin 134C (see FIG. 9B) of the connector 134. Although not shown, the connector 134 is additionally provided with multiple pins in addition to the pins 134A, 134B, and 134C.

The resistance value R1 is a value for setting the type of recording paper P used (e.g., one of plain paper, thick paper, and an envelope, but in this case, plain paper as an example). Specifically, when the resistance value R1 is detected, it is identified that the fixing device 100 is for plain paper. If a different type of recording paper P is used, the contact pressure and the preset fixation temperature at a contact area (i.e., a nip) between the fixing roller 102 and the belt member 104 would be different. Therefore, with regard to the resistance value R1, the fixed resistor 136 is used so as to prevent the operator from freely changing the value.

The resistance value RX is a value for setting the size of recording paper P to be used in (i.e., that allows a fixing process to be performed thereon by) the fixing device 100. Specifically, by detecting the resistance value RX, the size of recording paper P onto which an image can be fixed in the fixing device 100 is identified. With regard to the size of the recording paper P, if the type of recording paper P is the same (e.g., plain paper), the size of paper that allows a fixing process to be performed thereon is simply changed. Therefore, the variable resistor 138 is used.

The circuit board 132 is electrically connected to a sub-controller 70 provided within the operating section 14 via the connector 134 and wires 135. The sub-controller 70 is electrically connected to the controller 20 via a wire (not shown).

The sub-controller 70 detects the resistance value RX by using an analog detection circuit (not shown), performs analog-to-digital conversion on the resistance value RX, associates a paper width (paper-width setting) set in a preset table with the obtained value, and notifies the controller 20 of the paper width (i.e., size information of the recording paper P).

Referring to FIG. 11, there are eight paper-width settings, which are, for example, 0, 1, 2, 3, 4, 5, 6, and 7. The setting 0 corresponds to when RX=4.4 kΩ and the paper width is freely selectable. The setting 1 corresponds to when RX =9.6 kΩ and the paper width is equal to that of size SA3 (size A3+). The setting 2 corresponds to when RX=6.3 kΩ and the paper width is equal to that of size A3. The setting 3 corresponds to when RX=27 kΩ and the paper width is equal to that of size A4.

Furthermore, the setting 4 corresponds to when RX =5.3 kΩ and the paper width is equal to that of size A5. The setting 5 corresponds to when RX =15 kΩ, the setting 6 corresponds to when RX =8.2 kΩ, and the setting 7 corresponds to when RX is an open value. In this case, the settings 5, 6, and 7 do not have preset paper widths (and are used as auxiliaries). A paper width is the width of the recording paper P in a direction orthogonal to the transport direction thereof.

Configuration of Acquiring Section

Next, the acquiring section 140 will be described below.

Figure 10:
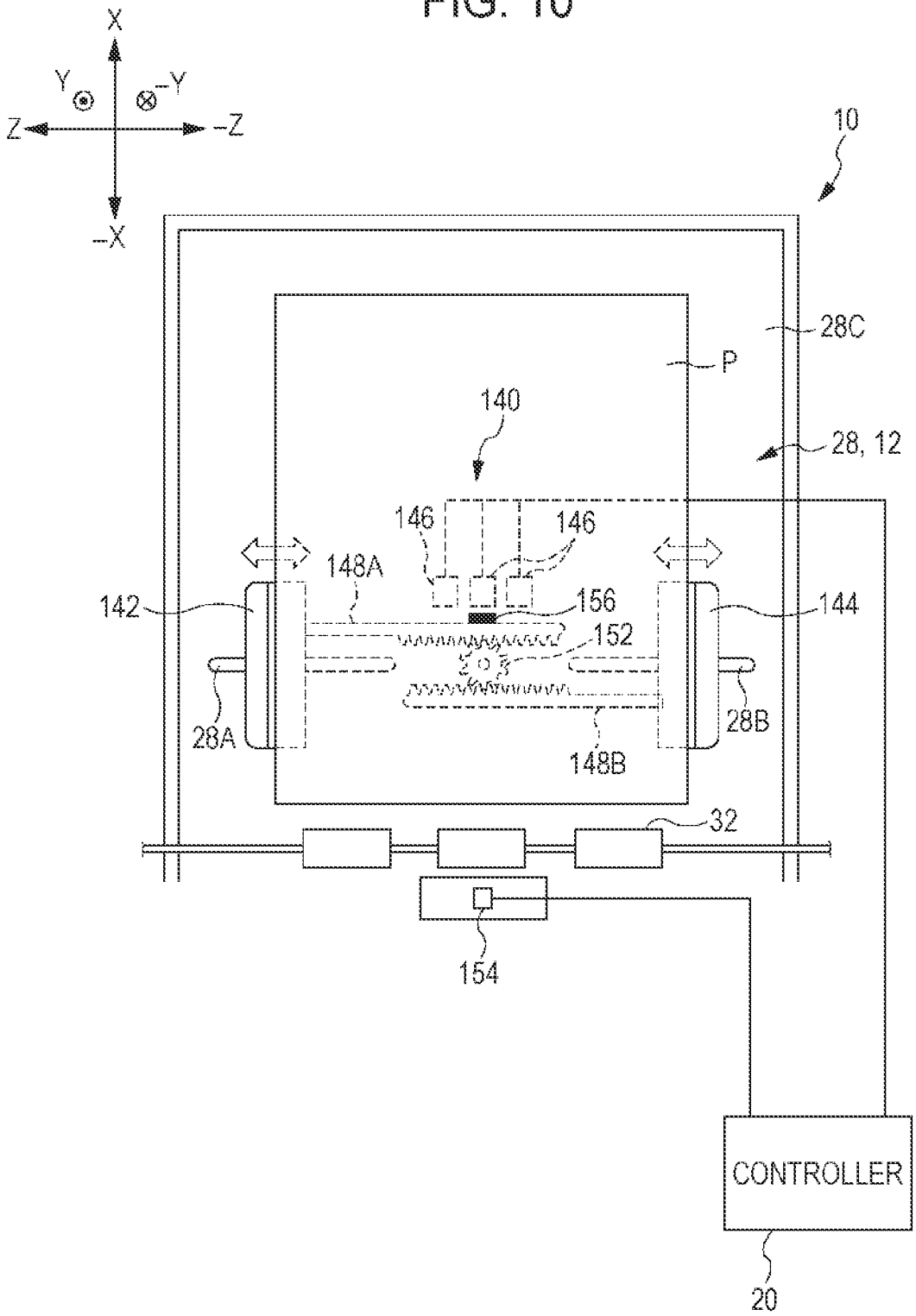
FIG. 10 illustrates a position-detection configuration of guides according to the exemplary embodiment of the present invention.

Referring to FIG. 10, for example, the fourth accommodation portion 28 is provided with the acquiring section 140.

The acquiring section 140 has a rear-side guide 142 and a front-side guide 144 that are movable in the Z direction and the –Z direction within the fourth accommodation portion 28, multiple guide sensors 146 that detect stopped positions of the rear-side guide 142 and the front-side guide 144 in the width direction (i.e., Z direction) thereof, and a paper sensor 154 that detects the width (i.e., the length) of the recording paper P in the transport direction thereof.

The rear-side guide 142 and the front-side guide 144 are movable in the Z direction and the –Z direction along sliding grooves 28A and 28B formed in a base 28C of the fourth accommodation portion 28. Furthermore, the rear-side guide 142 and the front-side guide 144 are used to position the recording paper P by abutting the rear-side guide 142 and the front-side guide 144 onto the widthwise edges of the recording paper P so as to align the widthwise edges of the recording paper P.

Moreover, the rear-side guide 142 and the front-side guide 144 are respectively connected to racks 148A and 148B provided at the underside (i.e., a side opposite to a side on which the recording paper P is placed) of the base 28C. In addition, the rack 148A extending from the rear-side guide 142 and the rack 148B extending from the front-side guide 144 are connected to each other via a pinion 152.

When one of the rear-side guide 142 and the front-side guide 144 slides (moves), the other guide slides in conjunction therewith due to the racks 148A and 148B and the pinion 152, such that the sliding distances of the two guides are equally controlled. The rear-side guide 142 and the front-side guide 144 are evenly spaced from the central position (not shown) in the Z direction.

The guide sensors 146 are, for example, reflective optical sensors that are spaced apart from each other in the Z direction. A detection surface of each guide sensor 146 that emits and receives light is disposed facing a side surface of the rack 148A. Furthermore, when the guide sensors 146 receive high-intensity light reflected at a reflecting member 156 provided on the side surface of the rack 148A, the guide sensors 146 output a signal to the controller 20. When the guide sensors 146 receive low-intensity light reflected at the side surface of the rack 148A (excluding the reflecting member 156), the guide sensors 146 do not output a signal to the controller 20.

Data related to widths of various sizes of recording paper P corresponding to the positions of (i.e., the distance between)

the rear-side guide 142 and the front-side guide 144 are set in advance in the controller 20 in correspondence with the respective guide sensors 146. Accordingly, when an output signal is received from any one of the guide sensors 146, data related to the width of recording paper P with a size that corresponds to the positions of (i.e., the distance between) the rear-side guide 142 and the front-side guide 144 is determined.

The paper sensor 154 is, for example, a reflective optical sensor, and a detection surface thereof that emits and receives light is disposed facing the recording paper P at a position downstream of the feed roller 32 in the transport direction A. When the recording paper P is present, the quantity of light received by the paper sensor 154 decreases, and the paper sensor 154 outputs an ON signal. Accordingly, for example, the length (i.e., the size) of the recording paper P in the transport direction is detected on the basis of a time period in which the paper sensor 154 is in an ON state and the transport speed of the recording paper P.

In this manner, the acquiring section 140 acquires size information of recording paper P onto which a developer image is to be fixed. The acquired size information of the recording paper P is stored in a memory (not shown) of the controller 20. Alternatively, the acquiring section 140 may be a recording-paper-P selection button (not shown) displayed on the display panel 51 (see FIG. 9A). As another alternative, the acquiring section 140 may be of a type that receives a command from a personal computer.

Configuration of Controller

Next, the controller 20 will be described below.

Referring to FIG. 9A, the controller 20 compares the size of recording paper P set in the setting section 130 with the size of recording paper P acquired by the acquiring section 140 (or input to the display panel 51) so as to determine whether or not a fixing process is performable in the fixing device 100 (see FIG. 1).

Specifically, if the size of recording paper P set in the setting section 130 and the size of recording paper P acquired by the acquiring section 140 are the same, the controller 20 makes the display panel 51 display selectable paper sizes (widths) (and commences the image forming process if an image formation command is received).

On the other hand, if the size of recording paper P set in the setting section 130 does not match the size of recording paper P acquired by the acquiring section 140, the controller 20 does not commence the image forming process and makes the display panel 51 display a message prompting the operator to replace the current fixing device 100 with a compatible one.

Operation

Next, the operation according to this exemplary embodiment will be described below.

As shown in FIG. 1, when the fixing device 100 is attached to the image forming apparatus 10 and the power thereof is turned on, the controller 20 acquires the size information (referred to as "size SA" hereinafter) of recording paper P set in the setting section 130 (see FIG. 4). Furthermore, the controller 20 acquires the size information (referred to as "size SB" hereinafter) of recording paper P acquired by the acquiring section 140 in the paper accommodation section 12.

If the size SA and the size SB are the same (for example, if both sizes are size A3), the controller 20 allows the image forming section 60 and the fixing device 100 to operate, and commences the image forming process in each section of the image forming apparatus 10. Then, the outer peripheral surfaces of the photoconductors 62 are electrostatically charged by the corresponding charging units 72 (see FIG. 2) and are exposed to the light beams L emitted from the corresponding exposure units 66 in accordance image data, whereby electrostatic latent images are formed on the outer peripheral surfaces of the photoconductors 62.

Subsequently, the electrostatic latent images formed on the outer peripheral surfaces of the photoconductors 62 are developed into yellow (Y), magenta (M), cyan (C), and black (K) toner images by the corresponding developing units 74 (see FIG. 2).

Then, the toner images formed on the surfaces of the photoconductors 62 are sequentially superposed and transferred onto the intermediate transfer belt 82 by the corresponding first-transfer rollers 84. Subsequently, the second-transfer roller 86 and the auxiliary roller 88 second-transfer the superposed toner images transferred on the intermediate transfer belt 82 onto the recording paper P transported along the transport path 30.

Then, the recording paper P having the toner images transferred thereon is transported toward the fixing device 100 by the transport belt 96. In the fixing device 100, the toner images on the recording paper P are heated and pressed so as to become fixed thereon. The recording paper P with the fixed toner images is output to, for example, the paper output section 13. Accordingly, a series of image forming steps is performed in this manner. If toner images are to be formed on a non-image face of the recording paper P not having an image formed thereon (i.e., if duplex printing is to be performed thereon), the recording paper P, after having the image fixed on one face thereof in the fixing device 100, is transported to the duplex transport path 31 so that another image is formed and fixed on the reverse face of the recording paper P.

Figure 13A:
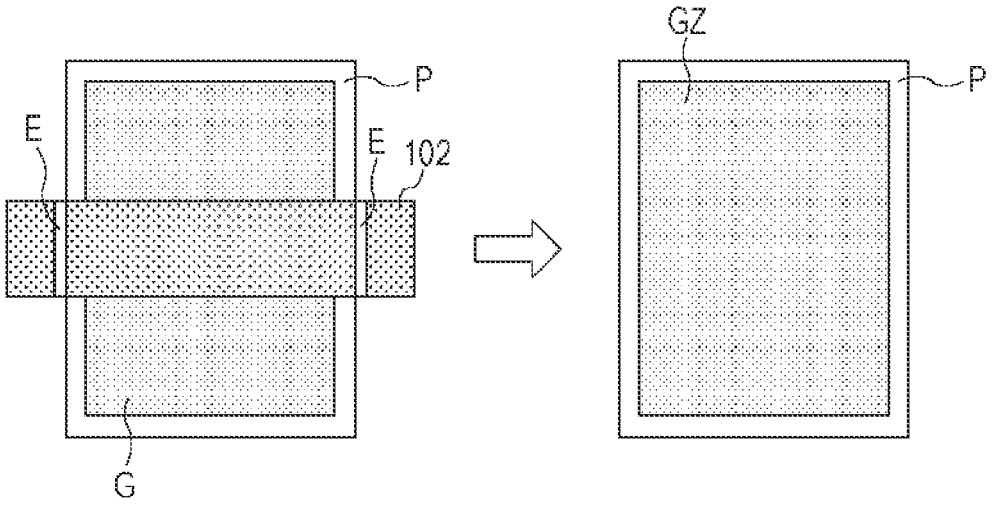
FIG. 13A schematically illustrates an image obtained when a toner image on recording paper is fixed thereon by the fixing device according to the exemplary embodiment of the present invention, and FIG. 13B schematically illustrates an image obtained when a toner image on recording paper is fixed thereon by a fixing device according to a comparative example.
Figure 13B:
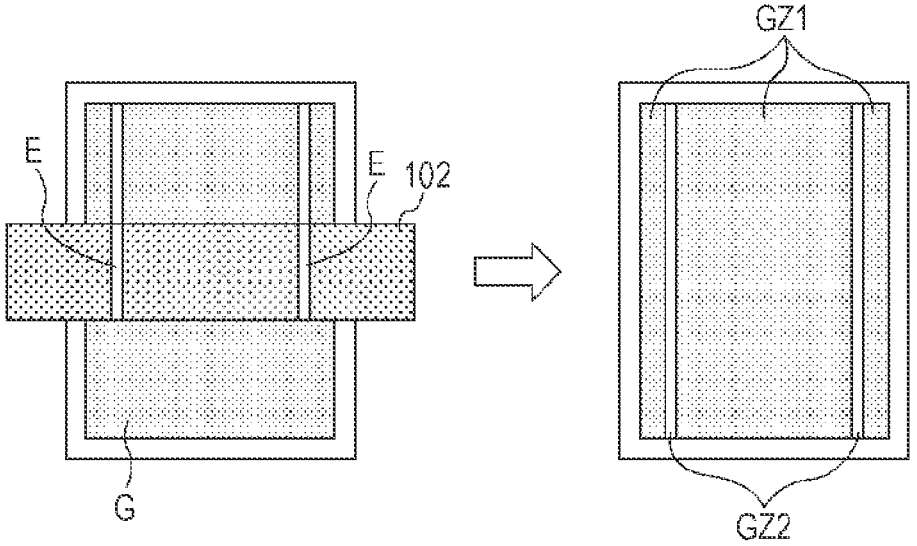

Referring to FIG. 13B, as a comparative example, if the size of recording paper P to be used and the size of recording paper P set in the fixing device 100 differ from each other, and the developer G is to be fixed onto large-size recording paper P after fixing a large amount of developer G onto small-size recording paper P, the fixing roller 102 would have steps E formed thereon as a result of coming into contact with the opposite widthwise edges of the small-size recording paper P. Therefore, when fixing the developer G, the heated state of the developer G would vary between areas corresponding to the steps E and other areas, thus causing a difference (such as uneven glossiness) to occur between image areas GZ1 and image areas GZ2 in the fixed image.

In contrast, referring to FIG. 13A, in this exemplary embodiment, because the size of recording paper P to be used and the size of recording paper P set in the fixing device 100 are the same, the steps E formed on the fixing roller 102 may hardly affect the image G even if the fixing process is continuously performed. Thus, the occurrence of uneven glossiness in a fixed image GZ may be suppressed.

If the size SA and the size SB determined by the controller 20 are different from each other, such a situation is coped with by employing one of the following patterns 1, 2, and 3.

Pattern 1

For example, the controller 20 makes the display panel 51 (see FIG. 3) display the following message: "Fixing Device is for Size SA. Please Replace With Fixing Device for Size SB". The image forming process is not performed until a fixing device for size SB is detected. Accordingly, a fixing process may be prevented from being performed on recording paper P by a fixing device 100 that does not comply with the size of the recording paper P. For example, Pattern 1 is used when the size SA and the size SB greatly differ from each other.

Pattern 2

Figure 12A:
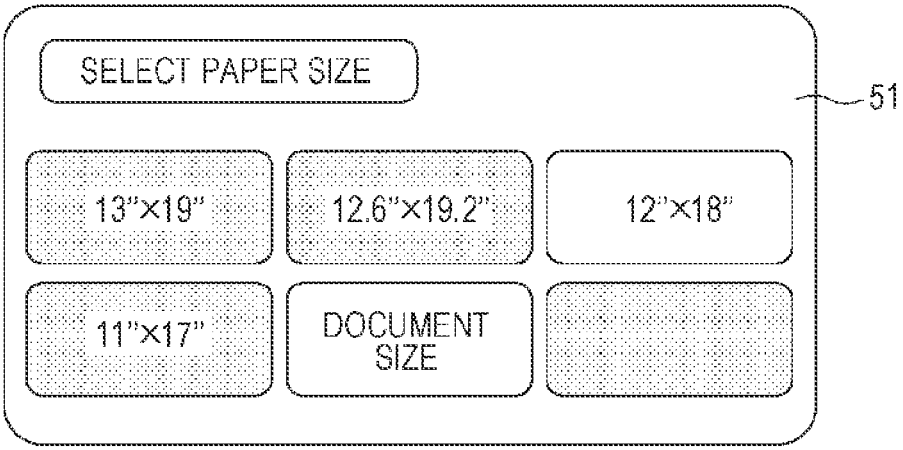
FIG. 12A illustrates an output-paper-size selection screen on a display panel according to the exemplary embodiment of the present invention.
Figure 12B:
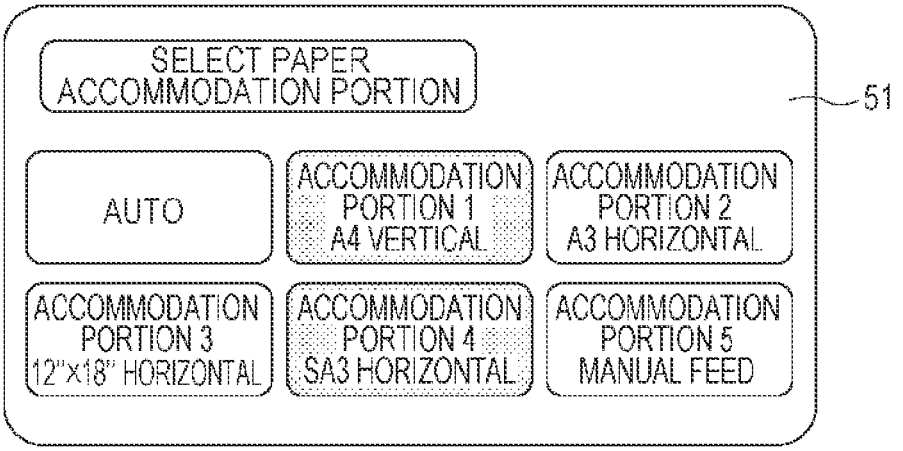
FIG. 12B illustrates a paper-accommodation-portion selection screen on the display panel according to the exemplary embodiment of the present invention.
Figure 12C:
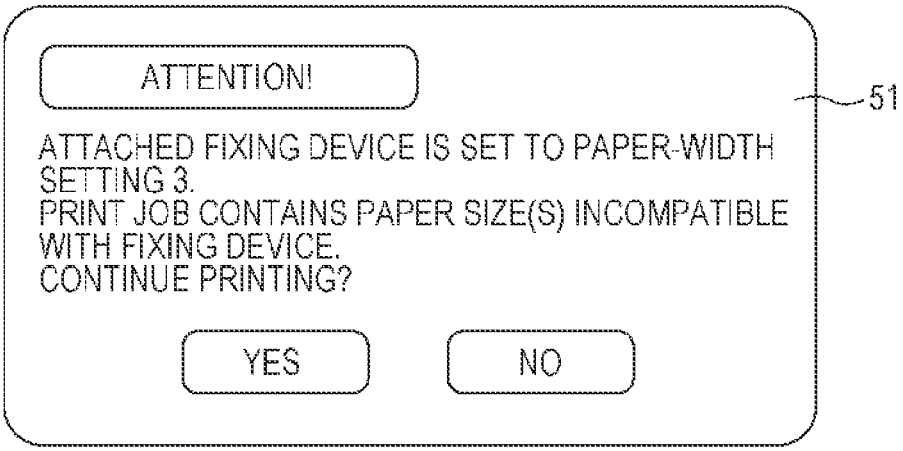
FIG. 12C illustrates a state where a message asking a user to make a selection is displayed on the display panel according to the exemplary embodiment of the present invention.

Referring to FIG. 12C, for example, the controller 20 makes the display panel 51 display a message asking whether or not to execute an image forming process (i.e., printing), and prompts the operator to make a selection ("YES" or "NO"). If "NO" is selected, a message prompting the operator to replace the fixing device 100 is displayed on the display panel 51. If "YES" is selected, the image forming process is commenced. Accordingly, if the image forming process (i.e., fixing process) is to be performed on, for example, several sheets, the process may be performed without having to replace the fixing device 100. For example, Pattern 2 is used when the size SA and the size SB greatly differ from each other.

Pattern 3

Referring to FIG. 12A, the controller 20 makes an output-paper-size selection screen on the display panel 51 to display only the outputtable paper sizes in a selectable mode (shown in a non-shaded state) and display the non-outputtable paper sizes in a non-selectable mode (shown in a shaded state). Alternatively, referring to FIG. 12B, the controller 20 may make a paper-accommodation-portion selection screen on the display panel 51 to display only the paper accommodation portions that accommodate outputtable recording paper P in a selectable mode (shown in a non-shaded state) and display the paper accommodation portions that accommodate non-outputtable recording paper P in a non-selectable mode (shown in a shaded state). Accordingly, a fixing process may be prevented from being performed on recording paper P by a fixing device 100 that does not comply with the size of the recording paper P. For example, Pattern 3 is used when the size SA and the size SB are of similar sizes.

Even when the controller 20 makes the display panel 51 display a message prompting the operator to replace the fixing device 100, if the operator does not desire to replace the fixing device 100 just for performing a fixing process on several sheets, the operator may forcedly select "START" by using the cursor buttons 53B and the selection button 53C (see FIG. 3), whereby the image forming process (i.e., fixing process) is performed. Consequently, the process may be performed without having to replace the fixing device 100.

In the image forming apparatus 10, since the variable resistor 138 is used in the setting section 130, the sizes of multiple types of recording paper P may be readily set, as compared with a configuration in which the size of recording paper P is set by using a fixed resistor. Moreover, the settings can be changed by using the variable resistor 138.

In the image forming apparatus 10, since the operator is notified of determination results by using the display panel 51, the operator may readily be notified of determination results, as compared with a configuration that does not use the display panel 51.

The exemplary embodiment of the present invention is not limited to the above.

As an alternative to a type that uses a fixing roller, the fixing device 100 may be of a type that uses a fixing belt that is heated by an electromagnetic induction method.

Furthermore, instead of being provided in the paper accommodation section 12, the acquiring unit may be of a type that detects the size of a document to be read by the document reading section 16 while correcting the size based on magnification information where necessary. The size of the document may be directly detected by detecting the edges of the document by using an optical sensor, or may be indirectly detected by detecting the position of a document guide member.

Furthermore, the notifying unit is not limited to a type that provides visual notification by displaying information on the display panel 51, and may alternatively be of a type that provides audio notification. Furthermore, in addition to providing notification that the fixing device 100 is non-usable, the notifying unit may provide notification that the fixing device 100 is usable.

Furthermore, the setting unit is not limited to the setting section 130 (i.e., variable resistor), and may be of a type in which multiple different values can be set. For example, the setting process may be performed by using a DIP switch having multiple switches.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing device that is attachable to and detachable from an apparatus body and fixes a developer image onto a recording medium;

a setting unit that is provided in the fixing device and in which a size of a recording medium to be used in the fixing device is set;

an acquiring unit that is provided in the apparatus body and acquires size information of a recording medium onto which the developer image is to be fixed;

a determining unit that compares the size of the recording medium set in the setting unit with the size of the recording medium acquired by the acquiring unit so as to determine whether or not a fixing process is performable by the fixing device; and a notifying unit that at least provides notification of a negative determination result obtained by the determining unit, wherein the setting unit is a variable resistor in which sizes of recording media are set in correspondence with different resistance values and in which the resistance values are switchable in the variable resistor by actuation of an operation knob.

2. The image forming apparatus according to claim 1, wherein the notifying unit is a display that is provided in the apparatus body and displays a determination result.

3. The image forming apparatus according to claim 1, wherein the apparatus body is provided with a selecting unit that is used by a user to select whether or not to use the fixing device attached to the image forming apparatus when the negative determination result is obtained by the determining unit.

4. The image forming apparatus according to claim 1, wherein the acquiring unit is configured to detect a width of the recording medium to determine the size of the recording medium.

5. The image forming apparatus according to claim 4, wherein the width of the recording medium is detected by using sensors.

6. An image forming method comprising:

setting a size of a recording medium to be used in an attachable/detachable fixing device by using a variable resistor in which sizes of recording media are set in correspondence with different resistance values and in which the resistance values are switchable in the variable resistor by actuation of an operation knob, the variable resistor being disposed on the fixing device;

acquiring size information of a recording medium onto which a developer image is to be fixed;

comparing the set size of the recording medium with the acquired size of the recording medium so as to determine whether or not a fixing process is performable by the fixing device; and at least providing notification of a negative determination result.

* * * * *